US010444648B2

(12) United States Patent
Asakawa

(10) Patent No.: US 10,444,648 B2
(45) Date of Patent: Oct. 15, 2019

(54) MAGNETIC TONER

(71) Applicant: KYOCERA Document Solutions Inc., Osaka (JP)

(72) Inventor: Tomoyasu Asakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/033,834

(22) Filed: Jul. 12, 2018

(65) Prior Publication Data

US 2019/0025723 A1 Jan. 24, 2019

(30) Foreign Application Priority Data

Jul. 19, 2017 (JP) ..... 2017-139973

(51) Int. Cl.
*G03G 9/083* (2006.01)
*G03G 9/093* (2006.01)

(52) U.S. Cl.
CPC ..... *G03G 9/0839* (2013.01); *G03G 9/0833* (2013.01); *G03G 9/09321* (2013.01); *G03G 9/09328* (2013.01); *G03G 9/09335* (2013.01); *G03G 9/09371* (2013.01); *G03G 9/09385* (2013.01)

(58) Field of Classification Search
CPC ..... G03G 9/09321; G03G 9/09371; G03G 9/09385; G03G 9/083; G03G 9/0839
See application file for complete search history.

(56) References Cited

U.S. PATENT DOCUMENTS 4,530,894 A * 7/1985 Imamura ..... G03G 9/083 428/405
4,554,232 A * 11/1985 Tabaru ..... G03G 9/08773 430/106.2
5,278,018 A * 1/1994 Young ..... G03G 9/0839 430/106.2
6,447,968 B1 9/2002 Ohno
6,579,653 B1 * 6/2003 Yuasa ..... G03G 9/081 430/108.2
2018/0314177 A1 * 11/2018 Ogawa ..... G03G 9/09364

FOREIGN PATENT DOCUMENTS

JP H10-239897 A 9/1998
JP 2000039737 A * 2/2000
JP 2006077314 A * 3/2006

OTHER PUBLICATIONS

English language machine translation of JP 2006-077314 (dated Mar. 2006).*
English language machine translation of JP 2000-039737 (dated Feb. 2000).*

* cited by examiner

*Primary Examiner* — Christopher D Rodee
(74) *Attorney, Agent, or Firm* — Studebaker & Brackett PC

(57) ABSTRACT

A magnetic toner includes toner particles. The toner particles each include a toner core and a shell layer covering a surface of the toner core. The toner cores contain a polyester resin and a magnetic powder. The magnetic powder includes specific magnetic particles. The shell layers contain a specific vinyl resin.

7 Claims, No Drawings

MAGNETIC TONER

INCORPORATION BY REFERENCE

The present application claims priority under 35 U.S.C. § 119 to Japanese Patent Application No. 2017-139973, filed on Jul. 19, 2017. The contents of this application are incorporated herein by reference in their entirety.

BACKGROUND

The present disclosure relates to a magnetic toner.

The magnetic toner includes toner particles containing a magnetic powder. A magnetic powder has been for example proposed which includes iron oxide particles surface-treated with a surface modifier.

SUMMARY

A magnetic toner according to an aspect of the present disclosure includes toner particles. The toner particles each include a toner core and a shell layer covering a surface of the toner core. The toner cores contain a polyester resin and a magnetic powder. The magnetic powder includes magnetic particles each having a surface treated through substitution with an epoxy group. The shell layers contain a copolymer of at least two vinyl compounds including at least a compound represented by formula (1-1) shown below.

(1-1)

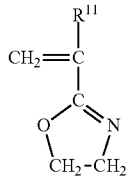

In formula (1-1), $R^{11}$ represents a hydrogen atom or an optionally substituted alkyl group.

DETAILED DESCRIPTION

The following describes an embodiment of the present disclosure. Unless otherwise stated, evaluation results (values indicating shape and physical properties) for a powder are number averages of values measured for a suitable number of particles included in the powder. Examples of powders include toner mother particles, an external additive, and a magnetic toner. The term "toner mother particles" used herein refers to toner particles yet to be treated through adhesion of an external additive thereto.

The term a "magnetic toner having excellent charge stability" used herein refers to a magnetic toner having the following first to third characteristics. The first characteristic is that the magnetic toner has a sharp charge distribution. The second characteristic is that the magnetic toner can be maintained at a desired amount of charge upon initiation of image formation using the magnetic toner. The third characteristic is that the magnetic toner can be maintained at a desired amount of charge during continuous image formation using the magnetic toner.

A number average primary particle diameter of a powder is a number average value of equivalent circle diameters of primary particles of the powder (Heywood diameter: diameters of circles having the same areas as projected areas of the particles) measured using a microscope, unless otherwise stated. A value for a volume median diameter ($D_{50}$) of a powder is measured based on Coulter principle (electrical sensing zone method) using "Coulter Counter Multisizer 3", product of Beckman Coulter, Inc., unless otherwise stated.

A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. A value for a softening point (Tm) is measured using a capillary rheometer ("CFT-500D", product of Shimadzu Corporation), unless otherwise stated. On an S-shaped curve (vertical axis: temperature, horizontal axis: stroke) measured using the capillary rheometer, the softening point (Tm) is a temperature corresponding to a stroke value of "(base line stroke value+maximum stroke value)/2".

The term a "main component" of a material used herein refers to a component that accounts for the largest proportion of the mass of the material, unless otherwise stated.

Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth) acrylonitrile" may be used as a generic term for both acrylonitrile and methacrylonitrile.

A magnetic toner according to the present embodiment is an electrostatic latent image developing magnetic toner that can be favorably used in development of electrostatic latent images. The magnetic toner according to the present embodiment is for example a positively chargeable magnetic toner (also referred to below simply as a "positively chargeable toner"). The magnetic toner according to the present embodiment can be used as a one-component developer. A positively chargeable toner used as a one-component developer is positively charged by friction with a development sleeve or a blade in a developing device.

The magnetic toner according to the present embodiment can for example be used in image formation in an electrophotographic apparatus (image forming apparatus). The following describes an example of image forming methods that are performed by electrophotographic apparatuses.

First, an electrostatic latent image is formed on a photosensitive member based on image data. Next, the formed electrostatic latent image is developed using a magnetic toner. In this developing step, the magnetic toner on a development sleeve (for example, a surface of a development roller in a developing device) disposed in the vicinity of the photosensitive member is caused to adhere to the electrostatic latent image to form a toner image on the photosensitive member. Subsequently, in a transfer step, the toner image on the photosensitive member is transferred onto a recording medium (for example, paper). Thereafter, the toner is heated to be fixed to the recording medium. As a result, an image is formed on the recording medium.

[Basic Features of Magnetic Toner]

The magnetic toner according to the present embodiment has the following features (referred to below as basic features). Specifically, the magnetic toner according to the present embodiment includes toner particles. The toner particles each include a toner core and a shell layer covering a surface of the toner core. The toner cores contain a polyester resin and a magnetic powder. The magnetic powder includes magnetic particles each having a surface treated through substitution with an epoxy group. The shell layers contain a copolymer of at least two vinyl compounds including at least a compound represented by formula (1-1) shown below. The magnetic particles each having a surface treated through substitution with an epoxy group are also referred to below as "specific magnetic particles". The compound represented by formula (1-1) is also referred to below as a "compound (1-1)". The copolymer of at least two vinyl compounds including the compound (1-1) is also referred to below as a "specific vinyl resin".

(1-1)

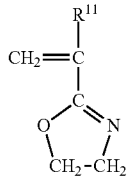

In formula (1-1), $R^{11}$ represents a hydrogen atom or an optionally substituted alkyl group. The alkyl group may for example be a straight chain alkyl group, a branched chain alkyl group, or a ring alkyl group. Examples of substituents of the optionally substituted alkyl group include a phenyl group. Preferably, $R^{11}$ represents a hydrogen atom, a methyl group, an ethyl group, or an isopropyl group.

As described above, the toner cores according to the present embodiment contain a polyester resin and a magnetic powder. The magnetic powder includes the specific magnetic particles. It is thought that the specific magnetic particles tend to have a relatively low surface free energy due to surfaces thereof treated through substitution with an epoxy group. As a result, affinity of the specific magnetic particles with resin domains (more specifically, domains formed by the polyester resin) of the toner cores is high enough for the specific magnetic particles to be uniformly dispersed in the resin domains. Thus, the specific magnetic particles can be prevented from being exposed at surfaces of the toner cores. Furthermore, the specific magnetic particles can be prevented from escaping from the toner cores.

It is possible to provide a magnetic toner having excellent charge stability by preventing the exposure and the escape of the magnetic particles. Accordingly, the use of the magnetic toner according to the present embodiment allows formation of high-quality images. Besides, it is possible to prevent the photosensitive member from being damaged due to contact with exposed or escaped magnetic particles by preventing the exposure and the escape of the magnetic particles. This is another reason why the use of the magnetic toner according to the present embodiment allows formation of high-quality images.

According to the present embodiment, the toner cores contain a polyester resin. The shell layers contain the specific vinyl resin. In general, a polyester resin has unreacted carboxyl groups. An oxazoline group is highly reactive with a carboxyl group. Furthermore, since it is possible to prevent the exposure of the magnetic particles, enough sites are easily reserved for reaction between the unreacted carboxyl groups and oxazoline groups at the surfaces of the toner cores. Accordingly, each shell layer tends to be formed over the entire surface of the corresponding toner core. More specifically, a shell layer coverage ratio (a percentage accounted for by the area of a shell layer-covered region of each toner core out of the overall surface area of the toner core) tends to be high. As a result, the magnetic toner can have improved low-temperature fixability and improved heat-resistant preservability.

The present embodiment can achieve a high shell layer coverage ratio through the toner cores containing a polyester resin and the shell layers containing the specific vinyl resin. The inventor of the present disclosure therefore first thought that it would be possible to prevent reduction in charge stability of the magnetic toner without using the specific magnetic particles by covering exposed or escaped magnetic particles with the shell layers. As a result of dedicated research, however, the inventor found that it was difficult to provide a magnetic toner having excellent charge stability without increasing affinity of the magnetic particles with the resin domains in the toner cores. The following describes what was contemplated by the inventor.

As described above, some of the magnetic particles may be exposed or escape unless the magnetic particles are the specific magnetic particles. In a situation in which some of the magnetic particles are exposed at the surfaces of the toner cores during production of the magnetic toner, for example, it is difficult to reserve enough sites for reaction between the unreacted carboxyl groups and the oxazoline groups at the surfaces of the toner cores due to regions thereof where the magnetic particles are exposed (magnetic particle exposure regions). It is therefore difficult to form the shell layers on the magnetic particle exposure regions. Accordingly, it is difficult to cover the magnetic particles exposed at the surfaces of the toner cores with the shell layers. Even if the shell layers are successfully formed on the magnetic particle exposure regions, the magnetic particles may be exposed at surfaces of the shell layers during the use of the magnetic toner. Such a problem is more likely to occur in the case of thin shell layers. If surfaces of the magnetic particles have a functional group (for example, carboxyl) that is highly reactive with the oxazoline groups, the shell layers are easily formed on the magnetic particle exposure regions. However, it is difficult to provide such magnetic particles (magnetic particles each having a surface having a functional group that is highly reactive with the oxazoline groups).

In a situation in which some of the magnetic particles escape from the toner cores during the use of the magnetic toner, the escaped magnetic particles may penetrate shell layers. Such a problem is more likely to occur in the case of thin shell layers. The magnetic particles that have penetrated the shell layers are easily exposed at surfaces of the toner particles and easily escape from the toner particles.

However, the specific magnetic particles that are used in the present embodiment have increased affinity with the resin domains. Thus, the specific magnetic particles can be prevented from being exposed at the surfaces of the toner cores during production of the magnetic toner. The specific magnetic particles can therefore be prevented from being exposed at the surfaces of the shell layers during the use of the magnetic toner even in the case of thin shell layers. As long as the specific magnetic particles have increased affinity with the resin domains, the specific magnetic particles can be prevented from escaping from the toner cores during the use of the magnetic toner. Thus, the specific magnetic particles can be prevented from being exposed at the surfaces of the toner particles and escaping from the toner particles even in the case of thin shell layers. Since the specific magnetic particles are used as described above, the magnetic toner according to the present embodiment can have improved charge stability even if the shell layers thereof are thin. For example, the magnetic toner can have improved charge stability even if the shell layers thereof have a thickness of no greater than 20 nm.

The following further describes the magnetic toner. Preferably, an amount of non-ring-opened oxazoline groups contained in 1 g of the magnetic toner as measured by gas chromatography-mass spectrometry is at least 0.10 μmol and no greater than 100 μmol. The non-ring-opened oxazoline groups have a ring structure and are highly positively chargeable. The oxazoline groups undergo ring-opening and form amide bonds through a reaction with the carboxyl groups. Accordingly, heat-resistant preservability, charge decay resistance, and a charge rise characteristic of the magnetic toner can be improved by controlling the degree of ring-opening of the oxazoline groups in the specific vinyl resin. Specifically, the heat-resistant preservability of the magnetic toner can be improved by causing ring-opening of the oxazoline groups to a certain degree in the specific vinyl resin. The charge decay resistance of the magnetic toner can be improved by not leaving too many oxazoline groups non-ring-opened in the specific vinyl resin. The charge rise characteristic of the magnetic toner can be improved by leaving the oxazoline groups non-ring-opened to a proper degree in the specific vinyl resin. The amount of the non-ring-opened oxazoline groups contained in 1 g of the magnetic toner can be determined according to a method described in association with examples described below or a method conforming therewith.

In general, amine compounds and ammonium compounds are known as positively chargeable charge control agents. However, amine compounds and ammonium compounds have a positive zeta potential in water. In contrast, polyester resins have a negative zeta potential in water. Mutual electrostatic attraction therefore tends to occur between a polyester resin and an amine compound or an ammonium compound. Consequently, production of toner cores containing a polyester resin and an amine compound or an ammonium compound is not easy. The use of polyester resins, styrene-based resins, or acrylic acid-based resins as materials of shell layers (shell materials) has been contemplated, but these resins all tend to be negatively charged through friction with a development sleeve or a blade. Therefore, it is not easy to provide a positively chargeable toner using such resins. However, according to the present embodiment, it is possible to easily provide a positively chargeable toner by using the specific vinyl resin as a shell material and controlling the degree of ring-opening of the oxazoline groups in the specific vinyl resin.

[Example of Materials of Magnetic Toner]

<Toner Core>

A binder resin is typically a main component (for example, at least 85% by mass) of the toner cores. Accordingly, properties of the binder resin are thought to have a great influence on overall properties of the toner cores. Properties (specific examples include hydroxyl value, acid value, Tg, and Tm) of the binder resin can be adjusted by using different resins in combination for the binder resin. The toner cores have a higher tendency to be anionic in a situation in which the binder resin has, for example, an ester group, a hydroxyl group, an ether group, an acid group, or a methyl group as a substituent, and have a higher tendency to be cationic in a situation in which the binder resin has, for example, an amino group as a substituent.

The toner cores contain a magnetic powder in addition to the binder resin. The toner cores may further contain at least one of a colorant, a releasing agent, and a charge control agent. The following describes the components in order.

(Binder Resin)

The binder resin includes a polyester resin as a main component. The binder resin may be composed only of a polyester resin or may further include a thermoplastic resin other than the polyester resin. Examples of thermoplastic resins other than the polyester resin that can be used include styrene-based resins, acrylic acid-based resins, olefin-based resins, vinyl resins, polyamide resins, and urethane resins. Examples of acrylic acid-based resins that can be used include acrylic acid ester polymers and methacrylic acid ester polymers. Examples of olefin-based resins that can be used include polyethylene resins and polypropylene resins. Examples of vinyl resins that can be used include vinyl chloride resins, polyvinyl alcohols, vinyl ether resins, and N-vinyl resins. Furthermore, copolymers of the resins listed above, that is, copolymers obtained through incorporation of a repeating unit into any of the resins listed above may be used as a thermoplastic resin for forming the toner particles. For example, styrene-acrylic acid-based resins and styrene-butadiene-based resins are also usable as thermoplastic resins composing the binder resin. The following describes a polyester resin in detail.

(Polyester Resin)

The polyester resin is a copolymer of at least one alcohol and at least one carboxylic acid. Examples of alcohols that can be used in synthesis of the polyester resin include di-, tri-, and higher-hydric alcohols shown below. Examples of dihydric alcohols that can be used include diols and bisphenols. Examples of carboxylic acids that can be used in synthesis of the polyester resin include di-, tri-, and higher-basic carboxylic acids shown below.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids, α,ω-alkane dicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkane dicarboxylic acids include malonic acid, succinic acid, adipic acid, suberic acid, azelaic acid, sebacic acid, and 1,10-decanedicarboxylic acid. Examples of preferable unsaturated dicarboxylic acids include maleic acid, fumaric acid, citraconic acid, itaconic acid, and glutaconic acid. Examples of preferable cycloalkane dicarboxylic acids include cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Magnetic Powder)

The magnetic powder is preferably composed of the specific magnetic particles but may further include magnetic particles that are not the specific magnetic particles (referred to below as "additional magnetic particles"). More specifically, the specific magnetic particles preferably account for at least 90% by mass of the magnetic powder.

(Specific Magnetic Particles)

Preferably, the specific magnetic particles are ferromagnetic metal oxide particles having surfaces treated with a specific silane coupling agent. In general, surfaces of the ferromagnetic metal oxide particles have hydroxyl groups (—OH groups). The silane coupling agent has alkoxy groups (—OR groups) bonded to a silicon atom. In the surface treatment of the ferromagnetic metal oxide particles with the specific silane coupling agent in a polar medium, therefore, the alkoxy groups are hydrolyzed to form hydroxyl groups, and then the thus formed hydroxyl groups undergo a dehydration condensation reaction with the hydroxyl groups of the surfaces of the ferromagnetic metal oxide particles. Thus, the specific magnetic particles are obtained. Water or an alcohol may be used as the polar medium. The polar medium may be acidic or basic.

The ferromagnetic metal oxide particles refer to particles of a ferromagnetic metal oxide. Examples of preferable ferromagnetic metal oxides include ferrite, magnetite, and chromium dioxide. The ferromagnetic metal oxide particles may include two or more ferromagnetic metal oxides. Preferably, the ferromagnetic metal oxide particles have a number average primary particle diameter of at least 100 nm and no greater than 200 nm.

Preferably, the specific silane coupling agent is a silane coupling agent represented by formula (2-1) shown below (referred to below as a "silane coupling agent (2-1)").

(2-1)

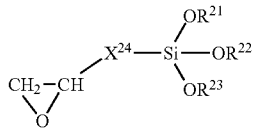

In formula (2-1), $R^{21}$, $R^{22}$, and $R^{23}$ each represent, independently of one another, an optionally substituted alkyl group. Preferably, $R^{21}$, $R^{22}$, and $R^{23}$ each represent, independently of one another, an alkyl group. $X^{24}$ represents an organic group. Preferably, $X^{24}$ represents an optionally substituted alkyl group.

Examples of the silane coupling agent (2-1) include 3-glycidoxypropyltrimethoxysilane, 3-glycidoxypropyltriethoxysilane, 3-glycidoxypropylmethyldimethoxysilane, and 2-(3,4-epoxycyclohexyl)ethyltrimethoxysilane. The 3-glycidoxypropyltrimethoxysilane is a compound represented by formula (2-2) shown below (referred to below as a "compound (2-2)").

(2-2)

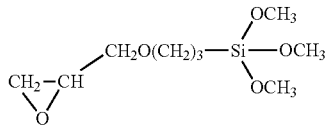

(Additional Magnetic Particles)

Preferably, the additional magnetic particles for example include a ferromagnetic metal, a ferromagnetic metal alloy, or a material subjected to ferromagnetization. Examples of ferromagnetic metals that can be used include iron, cobalt, and nickel. The ferromagnetization is for example a heat treatment. The additional magnetic particles may be surface-treated in order to inhibit elution of metal ions (for example, iron ions) from the magnetic particles.

(Colorant)

In order to form high-quality images using the positively chargeable toner, the toner cores preferably contain at least 1 part by mass and no greater than 20 parts by mass of a colorant relative to 100 parts by mass of the binder resin. A black colorant can be used as the colorant. Carbon black can for example be used as a black colorant.

(Releasing Agent)

The releasing agent is for example used in order to improve fixability or hot offset resistance of the positively chargeable toner. In order to increase the cationic strength of the toner cores, a cationic wax is preferably used to prepare the toner cores.

Examples of preferable releasing agents include aliphatic hydrocarbon waxes, plant waxes, animal waxes, mineral waxes, waxes having a fatty acid ester as a main component, and waxes in which a part or all of a fatty acid ester has been deoxidized. Examples of preferable aliphatic hydrocarbon waxes include low molecular weight polyethylene, low molecular weight polypropylene, polyolefin copolymer, polyolefin wax, microcrystalline wax, paraffin wax, and Fischer-Tropsch wax. Examples of aliphatic hydrocarbon waxes further include oxides of the waxes listed above. Examples of preferable plant waxes include candelilla wax, carnauba wax, Japan wax, jojoba wax, and rice wax. Examples of preferable animal waxes include beeswax, lanolin, and spermaceti. Examples of preferable mineral waxes include ozokerite, ceresin, and petrolatum. Examples of preferable waxes having a fatty acid ester as a main component include montanic acid ester wax and castor wax. One wax may be used independently, or two or more waxes may be used in combination.

In order to improve compatibility between the binder resin and the releasing agent, a compatibilizer may be added to the toner cores.

(Charge Control Agent)

The charge control agent is for example used in order to improve charge stability or a charge rise characteristic of the positively chargeable toner. The charge rise characteristic of the positively chargeable toner is an indicator as to whether the positively chargeable toner can be charged to a specific charge level in a short period of time. The cationic strength of the toner cores can be increased through the toner cores containing a positively chargeable charge control agent. The anionic strength of the toner cores can be increased through the toner cores containing a negatively chargeable charge control agent.

<Shell Layer>

Preferably, the shell layers have a thickness of at least 1 nm and no greater than 20 nm. The magnetic toner easily has improved heat-resistant preservability so long as the shell layers have a thickness of at least 1 nm. The magnetic toner easily has improved low-temperature fixability so long as the shell layers have a thickness of no greater than 20 nm. Since the specific magnetic particles are used in the present embodiment, charge stability of the magnetic toner can be effectively improved even with the shell layers having a thickness of as small as no greater than 20 nm. More preferably, the shell layers have a thickness of at least 5 nm and no greater than 10 nm.

The shell layers contain the specific vinyl resin. The shell layers are preferably composed of the specific vinyl resin but may further contain a resin other than the specific vinyl resin. A vinyl resin is a homopolymer or a copolymer including a vinyl compound. The vinyl compound has at least one functional group selected from a vinyl group ($CH_2$═CH—), a vinylidene group ($CH_2$═C<), and a vinylene group (—CH═CH—) in a molecule thereof. The vinyl compound forms a macromolecule (vinyl resin) through an addition polymerization involving cleavage of carbon-to-carbon double bonds (C═C) in molecules of the functional group such as the vinyl group.

(Specific Vinyl Resin)

The specific vinyl resin is a copolymer of at least two vinyl compounds including the compound (1-1) and a different vinyl compound. The different vinyl compound means a vinyl compound that is different from the compound (1-1). Preferably, the different vinyl compound is at least one vinyl compound selected from the group consisting of styrene-based monomers and acrylic acid-based monomers.

Examples of preferable styrene-based monomers include styrene, alkyl styrenes, hydroxystyrenes, and halogenated styrenes. Examples of preferable alkyl styrenes include α-methylstyrene, m-methylstyrene, p-methylstyrene, p-ethylstyrene, and 4-tert-butylstyrene. Examples of preferable hydroxystyrenes include p-hydroxystyrene and m-hydroxystyrene. Examples of preferable halogenated styrenes include α-chlorostyrene, o-chlorostyrene, m-chlorostyrene, and p-chlorostyrene.

Examples of preferable acrylic acid-based monomers include (meth)acrylic acid, (meth)acrylonitrile, alkyl (meth) acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

More specifically, the specific vinyl resin preferably includes a constitutional unit represented by formula (1-2) shown below (referred to below as a "constitutional unit (1-2)") and a constitutional unit represented by formula (1-3) shown below (referred to below as a "constitutional unit (1-3)"). The constitutional unit (1-2) includes an amide bond formed through a reaction between an unreacted carboxyl group and an oxazoline group. The constitutional unit (1-3) includes a non-ring-opened oxazoline group.

(1-2)

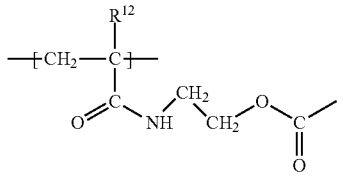

In formula (1-2), $R^{12}$ represents a hydrogen atom or an optionally substituted alkyl group. The alkyl group may be a straight chain alkyl group, a branched chain alkyl group, or a ring alkyl group. Examples of substituents of the optionally substituted alkyl group include a phenyl group. Preferably, $R^{12}$ represents a hydrogen atom, a methyl group, an ethyl group, or an isopropyl group. An available bond of a carbon atom bonded to two oxygen atoms in formula (1-2) is bonded to an atom forming a polyester resin.

(1-3)

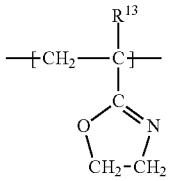

In formula (1-3), $R^{13}$ represents a hydrogen atom or an optionally substituted alkyl group. The alkyl group may be a straight chain alkyl group, a branched chain alkyl group, or a ring alkyl group. Examples of substituents of the optionally substituted alkyl group include a phenyl group. Preferably, $R^{13}$ represents a hydrogen atom, a methyl group, an ethyl group, or an isopropyl group.

[Example of Magnetic Toner Production Method]

Preferably, a method for producing the magnetic toner according to the present embodiment includes toner mother particle preparation. More preferably, the method further includes external additive addition. Preferably, a large number of toner particles are formed at the same time in order to produce the magnetic toner efficiently. Toner particles that are produced at the same time are thought to have substantially the same structure as one another.

<Toner Mother Particle Preparation>

Preferably, the toner mother particle preparation includes a magnetic powder preparation process, a toner core preparation process, a shell layer formation liquid preparation process, and a shell layer formation process.

(Magnetic Powder Preparation Process)

Preferably, the specific magnetic particles are prepared in the magnetic powder preparation process. More specifically, it is preferable that surfaces of ferromagnetic metal oxide particles are treated with the silane coupling agent (2-1) in a polar medium. The ferromagnetic metal oxide particles and the silane coupling agent (2-1) may be mixed in the polar medium, or the silane coupling agent (2-1) may be added into a dispersion containing the ferromagnetic metal oxide particles. Acidic ion exchanged water can for example be used as the polar medium. "Z-6040" produced by Dow Corning Toray Co., Ltd. can for example be used as the silane coupling agent (2-1). The "Z-6040" produced by Dow Corning Toray Co., Ltd. includes the compound (2-2).

(Toner Core Preparation Process)

Preferably, the toner cores are prepared by a known pulverization method in the toner core preparation process. More specifically, the magnetic powder obtained as described above and a polyester resin are mixed. At least one of a colorant, a releasing agent, and a charge control agent may be also mixed with the magnetic powder and the polyester resin. The resultant mixture is melt-kneaded using a melt-kneader (for example, a single or twin screw extruder). The resultant melt-kneaded product is pulverized and classified. Thus, the toner cores are obtained.

(Shell Layer Formation Liquid Preparation Process)

Preferably, a vinyl resin solution is prepared in the shell layer formation liquid preparation process. "EPOCROS (registered Japanese trademark) WS-300" produced by Nippon Shokubai Co., Ltd. can for example be used as the vinyl resin solution. "EPOCROS WS-300" contains a copolymer (water-soluble cross-linking agent) of 2-vinyl-2-oxazoline and methyl methacrylate. The monomers forming the copolymer are in a mass ratio of (2-vinyl-2-oxazoline):(methyl methacrylate)=9:1. The monomer 2-vinyl-2-oxazoline is equivalent to a vinyl compound represented by formula (1-1) wherein $R^{11}$ is a hydrogen atom.

(Shell Layer Formation Process)

In the shell layer formation process, the shell layers for covering the surfaces of the toner cores are formed. More specifically, the toner cores and the shell layer formation liquid are mixed at a specific temperature. The specific temperature is greater than or equal to a temperature at which the oxazoline groups react with the unreacted carboxyl groups (carboxyl groups in the polyester resin) to form amide bonds. Through the above, the shell layers are formed, and thus a dispersion of toner mother particles is obtained. The thus obtained dispersion of the toner mother particles is subjected to solid-liquid separation, washing, and drying. As a result, the toner mother particles are obtained.

Specifically, the toner cores and the shell layer formation liquid are mixed to obtain a dispersion first. The shell material adheres to the surfaces of the toner cores in the dispersion. In order that the shell material adheres to the surfaces of the toner cores in a uniform manner, a high degree of dispersion of the toner cores is preferably achieved in the dispersion. In order to achieve a high degree of dispersion of the toner cores in the dispersion, a surfactant may be added to the dispersion, or the dispersion may be stirred using a powerful stirrer (for example, "Hivis Disper Mix", product of PRIMIX Corporation).

Next, the dispersion is heated up to the specific temperature at a specific heating rate under stirring. Thereafter, the dispersion is kept at the specific temperature for a specific period of time under stirring. As described above, the specific temperature is greater than or equal to the temperature at which the oxazoline groups react with the unreacted carboxyl groups to form amide bonds. It is therefore thought that the reaction between the oxazoline groups and the unreacted carboxyl groups proceeds while the dispersion is kept at the specific temperature. Some of the oxazoline groups in molecules of the compound (1-1) react with the unreacted carboxyl groups to be ring-opened. Through the above, the constitutional unit (1-2) is formed. Some of the oxazoline groups that do not react with the unreacted carboxyl groups are not ring-opened (constitutional unit (1-3)). Thus, the shell layers are formed.

Preferably, the specific temperature is selected from a range of from 50° C. to 100° C. The specific temperature being at least 50° C. promotes the reaction between the oxazoline groups and the unreacted carboxyl groups. The specific temperature being no greater than 100° C. prevents melting of any of resin components in the course of formation of the shell layers. The resin components include the binder resin and the vinyl resin (vinyl resin in the shell layer formation liquid), and the specific vinyl resin.

Preferably, the specific heating rate is for example selected from a range of from 0.1° C./minute to 3° C./minute. Preferably, the specific period of time is for example selected from a range of from 30 minutes to 4 hours. Preferably, the dispersion is stirred at a rotational speed of at least 50 rpm and no greater than 500 rpm. This promotes the reaction between the oxazoline groups and the unreacted carboxyl groups.

Whether or not the toner cores and the shell layers are bonded to each other through amide bonds may for example be determined according to a method described below.

Specifically, a sample (toner particles or toner mother particles) is dissolved in a solvent. The resultant solution is placed in a test tube for nuclear magnetic resonance (NMR) measurement, and a $^1$H-NMR spectrum is measured using an NMR apparatus. It is generally known that in the $^1$H-NMR spectrum, a triplet signal derived from a secondary amide appears around a chemical shift δ of 6.5. Therefore, when a triplet signal is observed around a chemical shift δ of 6.5 in the measured $^1$H-NMR spectrum, it is presumed that the toner cores and the shell layers are bonded to each other through amide bonds. Measurement conditions for the $^1$H-NMR spectrum are for example as follows.

<Example of Measurement Conditions for $^1$H-NMR Spectrum>

NMR apparatus: Fourier transform nuclear magnetic resonance apparatus (FT-NMR) ("JNM-AL400", product of JEOL Ltd.)

Test tube for NMR measurement: 5-mm test tube

Solvent: Deuterated chloroform (1 mL)

Temperature of sample: 20° C.

Mass of sample: 20 mg

Number of times of accumulation: 128 times

Internal standard substance of chemical shift: Tetramethylsilane (TMS)

<External Additive Addition Process>

The toner mother particles and an external additive are mixed using a mixer (for example, an FM mixer, product of Nippon Coke & Engineering Co., Ltd.). Through the above, particles of the external additive adhere to surfaces of the toner mother particles. Thus, a toner that includes toner particles including the toner mother particles and the external additive is obtained.

EXAMPLES

The following describes examples of the present disclosure. Table 1 shows compositions of toners according to Examples and Comparative Examples. The amount (unit: % by mass) of an oxazoline group-containing macromolecule shown in Table 1 was calculated using formula (M-1) shown below. With respect to each of Examples and Comparative Examples, the "amount of toner cores" in formula (M-1) was 300 g. The "amount of solids in aqueous oxazoline group-containing macromolecule solution" in formula (M-1) was calculated using formula (M-2) shown below.

Amount of oxazoline group-containing macromolecule (unit: % by mass)=100×amount of solids in aqueous oxazoline group-containing macromolecule solution (unit: g)/amount of toner cores (unit: g) (M-1)

Amount of solids in aqueous oxazoline group-containing macromolecule solution (unit: g)=mass of aqueous oxazoline group-containing macromolecule solution (unit: g)×solids content of aqueous oxazoline group-containing macromolecule solution (unit: % by mass)/100 (M-2)

TABLE 1

| | | Shell layer Amount | | |
|---|---|---|---|---|
| Toner | Magnetic particles | Oxazoline group-containing macromolecule (% by mass) | Aqueous ammonia (mL) | Non-ring-opened oxazoline group [μmol/g] |
| TA-1 | C-1 | 1 | 6 | 0.1 |
| TA-2 | C-1 | 2 | 6 | 6.0 |

TABLE 1-continued

| Toner | Magnetic particles | Shell layer Amount: Oxazoline group-containing macromolecule (% by mass) | Shell layer Amount: Aqueous ammonia (mL) | Non-ring-opened oxazoline group [μmol/g] |
|---|---|---|---|---|
| TA-3 | C-1 | 4 | 9 | 70.0 |
| TA-4 | C-1 | 5 | 9 | 80.0 |
| TB-1 | C-1 | 0 | 0 | 0.0 |
| TB-2 | C-2 | 3 | 9 | 40.0 |

The following describes, in order, production methods, evaluation methods, and evaluation results of toners (magnetic toners) TA-1 to TA-4, TB-1, and TB-2 according to Examples and Comparative Examples. In evaluations in which errors might occur, an evaluation value was calculated by calculating the arithmetic mean of an appropriate number of measured values in order to ensure that any errors were sufficiently small.

[Production Method of Toner TA-1]

<Synthesis of Polyester Resin>

A flask (capacity: 5 L) equipped with a thermometer (more specifically, thermocouple), a nitrogen inlet tube, a drainage tube, a rectification column, and a stirring impeller was set up in an oil bath. The flask was charged with 1,200 g of propanediol, 1,700 g of terephthalic acid, and 3 g of tin(II) dioctanoate as an esterification catalyst. The internal temperature of the flask was raised up to 230° C. using the oil bath. The flask contents were caused to undergo a reaction (condensation reaction) under a nitrogen atmosphere over 15 hours while the internal temperature of the flask was kept at 230° C. The internal pressure of the flask was reduced to 8.0 kPa while the internal temperature of the flask was kept at 230° C. The flask contents were caused to undergo a reaction (condensation reaction) at a temperature of 230° C. and a pressure of 8.0 kPa until a reaction product (polyester resin) having a desired softening point (Tm) was obtained. Thus, a polyester resin A was obtained. The polyester resin A had a softening point (Tm) of 90° C.

<Preparation of Magnetic Particles>

An aqueous ferrous sulfate solution in an amount of 20 L (iron ion ($Fe^{2+}$) concentration: 1.5 mol/L) and an aqueous sodium hydroxide solution in an amount of 10 L (concentration: 20 mol/L) were mixed. The resultant liquid mixture was heated up to 90° C. Thus, an aqueous ferrous salt solution (pH 9) containing ferric hydroxide ($Fe(OH)_2$) was obtained. Air was passed through the aqueous solution at a rate of 100 L/minute for 120 minutes while the temperature of the aqueous solution was kept at 90° C. As a result, magnetite was obtained through oxidation of ferric hydroxide. The aqueous solution was adjusted to pH 8 through addition of an aqueous sulfuric acid solution to the aqueous solution to yield a magnetite-containing aqueous ferrous salt solution. The thus obtained aqueous solution was adjusted to pH 9 through addition of an aqueous sodium hydroxide solution (concentration: 20 mol/L) to the aqueous solution. Air was passed through the resultant aqueous solution at a rate of 100 L/minute for 60 minutes while the temperature of the aqueous solution was kept at 90° C. A solid was collected from the aqueous solution, washed with water, and then subjected to solid-liquid separation. The resultant solid was dried, and then pulverized using a pulverizer ("Hammer Mill HM-5", product of Nara Machinery Co., Ltd.). Through the above, magnetite particles were obtained. The magnetite particles had a sharp particle size distribution. More specifically, the magnetite particles included substantially only magnetite particles having a particle diameter of approximately 100 nm. Note that the thus obtained magnetite particles are equivalent to magnetic particles C-2 described below.

A dispersion was obtained by mixing 100 parts by mass of the magnetite particles and 300 parts by mass of ion exchanged water using a disperser ("Homomixer MARK II Model 2.5", product of PRIMIX Corporation). The resultant dispersion was adjusted to pH 4 through addition of hydrochloric acid to the dispersion. A silane coupling agent ("Z-6040", product of Dow Corning Toray Co., Ltd.) was added to the dispersion, and then the dispersion was stirred. Through the above, magnetic particles C-1 were obtained. The silane coupling agent was added to the dispersion such that the amount of the compound (2-2) contained in the coupling agent was 2 parts by mass relative to 100 parts by mass of the magnetite particles contained in the dispersion.

<Toner Core Preparation>

An FM mixer (product of Nippon Coke & Engineering Co., Ltd.) was used to mix 50 parts by mass of the polyester resin A, 45 parts by mass of the magnetic particles C-1, 4 parts by mass of a releasing agent ("NISSAN ELECTOL (registered Japanese trademark) WEP-3", product of NOF Corporation, ingredient: ester wax), and 1 part by mass of a charge control agent ("BONTRON (registered Japanese trademark) P-51", product of ORIENT CHEMICAL INDUSTRIES, Co., Ltd.). The resultant mixture was melt-kneaded using a twin screw extruder ("PCM-30", product of Ikegai Corp.) under conditions of a material feeding rate of 6 kg/hour, a shaft rotational speed of 160 rpm, and a set temperature (cylinder temperature) of 120° C. The resultant melt-kneaded product was cooled. After cooling, the melt-kneaded product was coarsely pulverized using a pulverizer ("Rotoplex 16/8", product of former TOA MACHINERY MFG.). The resultant coarsely pulverized product was finely pulverized using a pulverizer ("Turbo Mill Model RS", product of FREUND-TURBO CORPORATION). The resultant finely pulverized product was classified using a classifier ("Elbow-Jet EJ-LABO", product of Nittetsu Mining Co., Ltd.). As a result, toner cores having a volume median diameter ($D_{50}$) of 8.0 μm were obtained.

<Shell Layer Formation>

A flask (capacity: 1 L) equipped with a thermometer and a stirring impeller was charged with 300 mL of ion exchanged water, and then the flask was set up in a water bath. The internal temperature of the flask was kept at 30° C. using the water bath. Into the flask, 30 g of an aqueous oxazoline group-containing macromolecule solution ("EPOCROS WS-300", product of Nippon Shokubai Co., Ltd., solids content: 10% by mass, Tg: 90° C.) was added, and the flask contents were stirred. After 300 g of the toner cores were added into the flask, the flask contents were stirred at a rotational speed of 200 rpm for 1 hour. Into the flask, 300 mL of ion exchanged water and 6 mL of aqueous ammonia (concentration: 1% by mass) were added in order. The internal temperature of the flask was increased up to 60° C. at a heating rate of 0.5° C./minute while the flask contents were stirred at a rotational speed of 150 rpm. The flask contents were stirred at a rotational speed of 100 rpm for 1 hour while the internal temperature of the flask was kept at 60° C. The flask contents were adjusted to pH 7 through addition of aqueous ammonia (concentration: 1% by mass) into the flask. Thereafter, the internal temperature of the flask was reduced to room temperature. Through the above, a toner mother particle-containing dispersion was obtained.

<Washing>

The resultant dispersion was subjected to suction filtration using a Buchner funnel to obtain a wet cake of the toner mother particles. The thus obtained wet cake of the toner mother particles was dispersed in ion exchanged water. The resultant dispersion was subjected to suction filtration using a Buchner funnel. The above-described solid-liquid separation was repeated five times.

<Drying>

The toner mother particles obtained as described above were dispersed in a 50% by mass aqueous ethanol solution. Thus, a slurry of the toner mother particles was obtained. The toner mother particles in the slurry were dried using a continuous type surface modifier ("COATMIZER (registered Japanese trademark)", product of Freund Corporation) under conditions of a hot air flow temperature of 45° C. and a blower flow rate of 2 $m^3$/minute. Through the above, the toner mother particles were obtained.

<External Additive Addition>

An FM mixer ("FM-10B", product of Nippon Coke & Engineering Co., Ltd.) was used to mix 100.0 parts by mass of the toner mother particles and 0.5 parts by mass of hydrophobic silica particles ("AEROSIL (registered Japanese trademark) RA-200H", product of Nippon Aerosil Co., Ltd.) over 5 minutes. The resultant powder was sifted using a 200-mesh sieve (pore size: 75 μm). Thus, a toner (toner TA-1) including a number of toner particles was obtained.

[Production of Toners TA-2 to TA-4, TB-1, and TB-2]

The toners TA-2 to TA-4 were produced according to the same method as the production method of the toner TA-1 in all aspects other than that the amount of the oxazoline group-containing macromolecule was changed to the respective values shown in Table 1 and the amount of the aqueous ammonia was changed to the respective values shown in Table 1 in the shell layer formation.

The toner TB-1 was produced according to the same method as the production method of the toner TA-1 in all aspects other than that no shell layers were formed.

The toner TB-2 was produced according to the same method as the production method of the toner TA-1 in all aspects other than the following changes. That is, the amount of the oxazoline group-containing macromolecule was changed to the value shown in Table 1 and the amount of the aqueous ammonia was changed to the value shown in Table 1 in the shell layer formation. Furthermore, the magnetic particles C-2 were used.

[Measurement Method of Amount of Non-Ring-Opened Oxazoline Group]

With respect to each of the magnetic toners TA-1 to TA-4, TB-1, and TB-2, the amount of the non-ring-opened oxazoline groups in the magnetic toner was measured. More specifically, quantitative analysis was performed by gas chromatography-mass spectrometry (GC-MS) using a calibration curve (calibration curve based on standard substances) under the following conditions. The measurement results are shown in Table 1. For example, the amount of the non-ring-opened oxazoline groups in the toner TA-1 was 0.1 μmol relative to 1 g of the magnetic toner.

<GC/MS>

A gas chromatograph mass spectrometer ("GCMS-QP2010 Ultra", product of Shimadzu Corporation) and a multi-shot pyrolyzer ("FRONTIER LAB MULTI-FUNCTIONAL PYROLYZER (registered Japanese trademark) PY-3030D", product of Frontier Laboratories Ltd.) were used as measuring devices. A GC column ("AGILENT (registered Japanese trademark) J&W Ultra-inert Capillary GC Column DB-5ms", product of Agilent Technologies Japan, Ltd., phase: allylene phase having a polymer main chain strengthened by introducing allylene to siloxane polymer, inner diameter: 0.25 mm, film thickness: 0.25 μm, length: 30 m) was used.

(Gas Chromatography)

Carrier gas: Helium (He) gas

Carrier flow rate: 1 mL/minute

Vaporizing chamber temperature: 210° C.

Thermal decomposition temperature: 600° C. in heating furnace, 320° C. in interface portion Heating condition: Temperature kept at 40° C. for 3 minutes, raised from 40° C. to 300° C. at a rate of 10° C./minute, and kept at 300° C. for 15 minutes (Mass Spectrometry)

Ionization method: Electron impact (EI) method

Ion source temperature: 200° C.

Interface portion temperature: 320° C.

Detection mode: Scan (measurement range: from 45 m/z to 500 m/z)

[Evaluation Methods]

<Evaluation of Charge Decay Resistance>

A charge decay constant α of a sample (more specifically, each of the magnetic toners TA-1 to TA-4, TB-1, and TB-2) was measured in accordance with Japanese Industrial Standard (JIS) C 61340-2-1-2006 using an electrostatic diffusivity measuring device ("NS-D100", product of Nano Seeds Corporation). The following describes a measurement method of the charge decay constant α of the magnetic toner.

The sample was placed in a measurement cell. The measurement cell was a metal cell having a recess of 10 mm in inner diameter and 1 mm in depth. The sample was pressed into the recess of the cell from above using slide glass to fill the recess. A portion of the sample that overflowed the cell was removed by moving the slide glass back and forth on the surface of the cell. The recess was filled with from 0.04 g to 0.06 g of the sample.

Subsequently, the measurement cell containing the sample was left to stand for 12 hours under environmental conditions of a temperature of 32.5° C. and a relative humidity of 80%. Subsequently, the measurement cell was grounded and placed in the electrostatic diffusivity measuring device. Ions were supplied to the sample by corona discharge to charge the sample. The sample was charged for 0.5 seconds under a condition of a probe gap of 1 mm. The surface potential of the sample was measured continuously starting from 0.7 seconds after completion of the corona discharge under a condition of a sampling frequency of 1 Hz. The charge decay constant (charge decay rate) a was calculated based on the measured surface potential and the following formula: $V=V_0\exp(-\alpha\sqrt{t})$. In the equation, V represents surface potential [V], $V_0$ represents initial surface potential [V], and t represents decay time [second].

Charge decay resistance was evaluated in accordance with the following evaluation standard. Evaluation results are shown in Table 2.

Good: A charge decay constant α of less than 0.030

Poor: A charge decay constant α of at least 0.030

<Evaluation of Charge Stability>

With respect to each of the magnetic toners TA-1 to TA-4, TB-1, and TB-2, an image having a coverage of 4% was printed on 10,000 successive sheets of printing paper (A4 size) with the magnetic toner as a developer using a monochrome printer ("FS-C4020N", product of KYOCERA Document Solutions Inc.) under environmental conditions of a temperature of 20° C. and a relative humidity of 65%. The developer (magnetic toner) was taken out of a developing device of the printer, and an amount of charge of the toner (charge after the 10,000-sheet printing) was measured. The developer taken out was returned into the developing device and used to print an image having a coverage of 4% on 90,000 successive sheets of printing paper (A4 size). The developer (magnetic toner) was taken out of the developing device, and an amount of charge of the toner (charge after the 100,000-sheet printing) was measured.

The amount of charge after the 10,000-sheet printing and the amount of charge after the 100,000-sheet printing were determined according to a method described below. Specifically, with respect to each of the magnetic toners TA-1 to TA-4, TB-1, and TB-2, a measurement cell of a Q/m meter ("MODEL 210HS-1", product of Trek, Inc.) was charged with 0.10 g of the magnetic toner as a measurement target. The magnetic toner was sucked through a sieve (metal mesh) for 10 seconds. The amount of charge (unit: μC/g) after the 10,000-sheet printing and the amount of charge (unit: μC/g) after the 100,000-sheet printing were calculated based on the following expression: "total amount of electricity of sucked toner (unit: μC)/mass of sucked toner (unit: g)".

Charge stability was evaluated according to the following standard. Evaluation results are shown in Table 2.

(Amount of Charge after 10,000-sheet Printing)

Good: An amount of charge after the 10,000-sheet printing of at least 8 μC/g and no greater than 12 μC/g Poor: An amount of charge after the 10,000-sheet printing of less than 8 μC/g or greater than 12 μC/g (Amount of Charge after 100,000-sheet Printing)

Good: An amount of charge after the 100,000-sheet printing of at least 8 μC/g and no greater than 12 μC/g Poor: An amount of charge after the 100,000-sheet printing of less than 8 μC/g or greater than 12 μC/g (Charge Difference Absolute Value)

Good: A charge difference absolute value of no greater than 1 μC/g

Poor: A charge difference absolute value of greater than 1 μC/g

Note that the charge difference absolute value means an absolute value of a difference obtained by subtracting the amount of charge after the 10,000-sheet printing from the amount of charge after the 100,000-sheet printing.

<Evaluation of Heat-Resistant Preservability>

With respect to each of the magnetic toners TA-1 to TA-4, TB-1, and TB-2, a polyethylene container (capacity: 20 mL) was charged with 3 g of the magnetic toner as a sample. The container was then left to stand without a lid for 12 hours under environmental conditions of a temperature of 23° C. and a relative humidity of 50%. The container was lidded, and then left to stand in an oven (set temperature: 55° C.) for 3 hours. Thereafter, the container was taken out of the oven and cooled to room temperature (approximately 25° C.). Subsequently, the magnetic toner was taken out of the container. Through the above, an evaluation toner was obtained.

The evaluation toner was placed on a 200-mesh sieve (pore size: 75 μm) of known mass. The mass of the toner before sifting was calculated by measuring the total mass of the sieve and the evaluation toner thereon. Subsequently, the sieve was set in POWDER TESTER (registered Japanese trademark, product of Hosokawa Micron Corporation) and the evaluation toner was sifted by shaking the sieve for 30 seconds at a rheostat level of 5 in accordance with a manual of the POWDER TESTER. After the sifting, the mass of toner remaining on the sieve (toner that did not pass through the sieve) was calculated by measuring the total mass of the sieve and the toner thereon. An aggregation rate (unit: % by mass) was calculated from the mass of the toner before sifting and the mass of the toner after sifting (mass of the toner remaining on the sieve after sifting) in accordance with a formula shown below.

$$\text{Aggregation rate} = 100 \times \text{mass of toner after sifting} / \text{mass of toner before sifting}$$

Heat-resistant preservability was evaluated according to the following standard. Evaluation results are shown in Table 3.

Good: An aggregation rate of less than 20%

Poor: An aggregation rate of at least 20%

<Evaluation of Low-Temperature Fixability>

An evaluation apparatus obtained by modifying a monochrome printer ("FS-C4020N", product of KYOCERA Document Solutions Inc.) to enable adjustment of fixing temperature was used. With respect to each of the magnetic toners TA-1 to TA-4, TB-1, and TB-2, the magnetic toner was loaded into a developing device of the evaluation apparatus. The evaluation apparatus was kept in a power-off state and left to stand for 10 minutes under environmental conditions of a temperature of 20° C. and a relative humidity of 65%. Thereafter, the evaluation apparatus was powered on. The evaluation apparatus was then used to perform the following evaluation.

Specifically, bias of the evaluation apparatus was adjusted such that a toner application amount to recording paper was 1.0 mg/cm$^2$. An unfixed solid image (size: 25 mm×25 mm) was formed on printing paper (A4 size plain paper, basis weight: 90 g/m$^2$) under environmental conditions of a temperature of 20° C. and a relative humidity of 65% while conveying the printing paper at a linear velocity of 200 mm/second.

The printing paper with the unfixed solid image formed thereon was passed through a fixing device of the evaluation apparatus. The fixing temperature of the fixing device of the evaluation apparatus (specifically, the temperature of a fixing roller included in the fixing device of the evaluation apparatus) was raised in increments of 5° C. from 100° C. to 200° C. Through the above, solid images (21 solid images) fixed at respective fixing temperatures were obtained.

Determination of whether or not cold offset occurred was carried out by performing a fold-rubbing test using each of the solid images. Specifically, the printing paper was folded in half such that a surface thereof on which the solid image had been fixed was folded inwards. A 1-kg weight covered with cloth was rubbed back and forth on the fold of the printing paper five times. Thereafter, the printing paper was opened up and a fold portion of the printing paper was observed. More specifically, a portion to which the solid image had been fixed was observed to measure a length of toner peeling (referred to below as "peeling length") thereon. It was determined that cold offset did not occur if the peeling length was less than 1.0 mm. It was determined that cold offset occurred if the peeling length was at least 1.0 mm. The lowest temperature among fixing temperatures at which cold offset did not occur was determined (minimum fixable temperature).

Low-temperature fixability was evaluated according to the following standard. Evaluation results are shown in Table 3.

Good: A minimum fixable temperature of no greater than 150° C.

Poor: A minimum fixable temperature of greater than 150° C.

[Evaluation Results]

Table 2 shows the results of the evaluation of charge characteristics of the magnetic toners. In Table 2, "Constant α" means charge decay constant α. Table 3 shows the results of the evaluation of heat-resistant preservability and low-temperature fixability of the magnetic toners. In Tables 2 and 3, the evaluation on each magnetic toner is shown in parentheses.

TABLE 2

| | Toner | Constant α | Amount of charge (μC/g) After 10,000-sheet printing | Amount of charge (μC/g) After 100,000-sheet printing | Charge difference absolute value (μC/g) |
|---|---|---|---|---|---|
| Example 1 | TA-1 | 0.018 (Good) | 8.7 (Good) | 8.1 (Good) | 0.6 (Good) |
| Example 2 | TA-2 | 0.019 (Good) | 9.0 (Good) | 8.6 (Good) | 0.4 (Good) |
| Example 3 | TA-3 | 0.023 (Good) | 10.8 (Good) | 10.6 (Good) | 0.2 (Good) |
| Example 4 | TA-4 | 0.029 (Good) | 11.1 (Good) | 11.0 (Good) | 0.1 (Good) |
| Comparative Example 1 | TB-1 | 0.016 (Good) | 7.0 (Poor) | 6.2 (Poor) | 0.8 (Good) |
| Comparative Example 2 | TB-2 | 0.021 (Good) | 7.8 (Poor) | 6.7 (Poor) | 1.1 (Poor) |

TABLE 3

| | Toner | Aggregation rate (%) | Minimum fixable temperature (° C.) |
|---|---|---|---|
| Example 1 | TA-1 | 18 (Good) | 140 (Good) |
| Example 2 | TA-2 | 16 (Good) | 140 (Good) |
| Example 3 | TA-3 | 8 (Good) | 145 (Good) |
| Example 4 | TA-4 | 4 (Good) | 145 (Good) |
| Comparative Example 1 | TB-1 | 29 (Poor) | 135 (Good) |
| Comparative Example 2 | TB-2 | 10 (Good) | 145 (Good) |

The toners TA-1 to TA-4 (more specifically, the magnetic toners according to Examples 1 to 4) each had the above-described basic features. Specifically, the toners TA-1 to TA-4 each included toner particles. The toner particles each included a toner core and a shell layer covering a surface of the toner core. The toner cores contained a polyester resin and a magnetic powder. The magnetic powder included the specific magnetic particles. The shell layers contained the specific vinyl resin. As for such toners TA-1 to TA-4, as indicated in Table 2, the charge decay constant α was low, the amount of charge after the 10,000-sheet printing was within the desired range, the amount of charge after the 100,000-sheet printing was within the desired range, and the charge difference absolute value was within the desired range. Furthermore, as indicated in Table 3, the aggregation rate was low, and the minimum fixable temperature was low.

The toners TB-1 and TB-2 (more specifically, the magnetic toners according to Comparative Examples 1 and 2) did not have the above-described basic features. Specifically, the toner TB-1 had no shell layers. As for the toner TB-1, the amount of charge after the 10,000-sheet printing was below the desired range, the amount of charge after the 100,000-sheet printing was below the desired range, and the aggregation rate was high.

The magnetic powder in the toner TB-2 did not include the specific magnetic particles. As for the toner TB-2, the amount of charge after the 10,000-sheet printing was below the desired range, the amount of charge after the 100,000-sheet printing was below the desired range, and the charge difference absolute value was large. The inventor rationalized the results as follows. The magnetic powder used in the toner TB-2 included magnetite particles. Accordingly, surface resistance of the magnetic powder (magnetite particles) easily decreased as the toner TB-2 was used over a long period of time. This is why the amount of charge after the 10,000-sheet printing of the toner TB-2 was below the desired range, and the amount of charge after the 100,000-sheet printing of the toner TB-2 was below the desired range.

Note that the inventor measured a $^{1}$H-NMR spectrum of each of the toners TA-1 to TA-4, and TB-2, and thus confirmed that the toner cores and the shell layers thereof were bonded to each other through amide bonds.

What is claimed is:

1. A magnetic toner comprising toner particles, wherein the toner particles each include a toner core and a shell layer covering a surface of the toner core, each toner core contains a polyester resin and a magnetic powder, the magnetic powder includes magnetic particles, the shell layers contain a copolymer of at least two vinyl compounds including at least a compound represented by formula (1-1) shown below, and the magnetic particles are ferromagnetic metal oxide particles, surfaces of which are subjected to surface treatment with a compound represented by formula (2-1) shown below, (1-1)

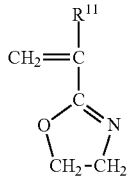

where in the formula (1-1), $R^{11}$ represents a hydrogen atom or an optionally substituted alkyl group, and (2-1)

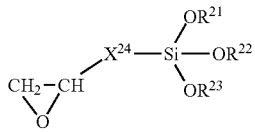

in the formula (2-1), $R^{21}$, $R^{22}$, and $R^{23}$ each represent, independently of one another, an optionally substituted alkyl group, and $X^{24}$ represents an organic group.

2. The magnetic toner according to claim 1, wherein the magnetic toner includes non-ring-opened oxazoline groups in an amount of at least 0.1 μmol/g and no greater than 100.0 μmol/g as measured by gas chromatography-mass spectrometry.

3. The magnetic toner according to claim 1, wherein the at least two vinyl compounds include at least one vinyl compound selected from the group consisting of styrene-based monomers and acrylic acid-based monomers.

4. The magnetic toner according to claim 1, wherein the copolymer of the at least two vinyl compounds includes a constitutional unit represented by formula (1-2) shown below and a constitutional unit represented by formula (1-3) shown below, (1-2)

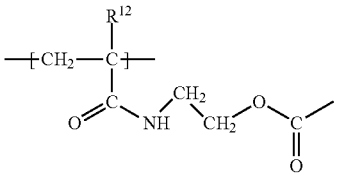

where in the formula (1-2), $R^{12}$ represents a hydrogen atom or an optionally substituted alkyl group, and an available bond of a carbon atom bonded to two oxygen atoms is bonded to an atom forming the polyester resin, and (1-3)

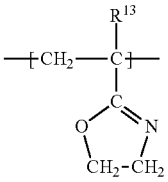

in the formula (1-3), $R^{13}$ represents a hydrogen atom or an optionally substituted alkyl group.

5. The magnetic toner according to claim 1, wherein the magnetic particles account for at least 90% by mass of the magnetic powder.

6. The magnetic toner according to claim 1, wherein the shell layers have a thickness of at least 5 nm and no greater than 10 nm.

7. The magnetic toner according to claim 1, wherein the compound represented by the formula (2-1) is selected from the group consisting of 3-glycidoxypropyltrimethoxysilane, 3-glycidoxypropyltriethoxysilane, and 2-(3,4-epoxycyclohexyl)ethyltrimethoxysilane.

* * * * *